United States Patent [19]

Cyphelly

[11] 4,404,895

[45] Sep. 20, 1983

[54] FLUID PRESSURE UNIT WITH HYDROSTATIC TORQUE TRANSMISSION BY ROLLER PISTONS

[76] Inventor: Ivan J. Cyphelly, Neuhaus, CH-8128 Hinteregg, Switzerland

[21] Appl. No.: 150,222

[22] Filed: May 12, 1980

[30] Foreign Application Priority Data

May 18, 1979 [CH] Switzerland ..... 4687/79

[51] Int. Cl.[3] ..... F01B 1/06

[52] U.S. Cl. ..... 91/488

[58] Field of Search ..... 91/488, 499

[56] References Cited

U.S. PATENT DOCUMENTS

| | | | |
|---|---|---|---|
| 3,523,678 | 8/1970 | Wright | 91/499 |
| 3,858,487 | 1/1975 | Abe | 91/488 |
| 3,899,880 | 8/1975 | Rohs | 91/499 |
| 3,960,057 | 1/1976 | Kometani | 91/498 |

FOREIGN PATENT DOCUMENTS

| | | | |
|---|---|---|---|
| 2731474 | 1/1978 | Fed. Rep. of Germany | 91/488 |

*Primary Examiner*—William L. Freeh

*Attorney, Agent, or Firm*—Browdy & Neimark

[57] ABSTRACT

A cylinder block (1) has radial bores (3) of rectangular cross section with a piston comprising a hollow roller (5) and a piston cap (4). The rollers (5) are supported on an outer cam (2). The piston caps (4) are periodically exposed to the pressure (p) of a medium which is delivered to them via channels (11, 13) in side sealing plates (6,7) and via the hollow spaces (10) of the rollers (5). The piston caps (4) are provided with sealing strips (17, 18) resting on bore walls (8, 9) and with support ribs (19, 20). Each roller (5), with the two associated bore walls (8, 9), forms gaps each of which, together with the one sealing strip (17, 18) and bore wall (8, 9) define an intermediate chamber ($p_c$, $p_o$). From the intermediate chambers ($p_c$, $p_o$) channels (25, 26) lead in the piston cap (4) to the support faces (23, 24) of the support ribs (19, 20). The support face (23) lifting away during operation at a predetermined inclination of the cam (2) places the intermediate chamber with which it communicates under an intermediate pressure ($p_c$) determined by the pertinent gap ($h_c$) of the roller (5) and the bore wall (8), this intermediate pressure ($p_c$) forcing a speed upon the cylinder block (1). The oppositely located intermediate chamber having low pressure ($p_o$) is sealed off from the pressure (p) of the medium by the support face (24) of the other support rib (20) resting on the other bore wall (9). As a result, it is possible to reduce unavoidable leakage losses without impairing the mechanical efficiency of the unit.

2 Claims, 3 Drawing Figures

FLUID PRESSURE UNIT WITH HYDROSTATIC TORQUE TRANSMISSION BY ROLLER PISTONS

BACKGROUND OF THE INVENTION

From U.S. Pat. No. 4,144,798 of the Applicant, a fluid pressure unit with a cylinder block is known which has radial bores of rectangular cross section. Each piston has a piston cap periodically exposed to pressure from a medium and a roller supported on the piston cap. The rollers are supported on a cam surrounding the cylinder block and producing at least one stroke. Each roller, together with a first of the two side walls of the radial bore disposed perpendicular to the direction of rotation, forms a variable gap, and each piston cap forms a sealing point together with the second of the two side walls. An intermediate pressure chamber exposed to the pressure of the medium is located between the variable gap and the piston cap along the first side wall.

In this known fluid pressure unit, pressure distributions are attained at the rollers which effect the deflection of force, these pressure distributions simultaneously effecting the establishment of the variable gap and the transmission of the torque force. The two structural components of each piston, namely the piston cap and the roller, accordingly function within the rectangular piston bore both in a sealing fashion and, by the creation of suitable pressure fields, in a force-transmitting fashion.

SUMMARY OF THE INVENTION

The principal object of the present invention is to provide a fluid pressure unit of the general type described above in which there is a reduction in the unavoidable leakage losses of pressure medium with no impairment of the mechanical efficiency of the unit.

According to the invention, this is attained in a fluid pressure unit of the type generally described by the preamble to claim 1 by providing each piston and the areas of the cylinder block adjacent thereto with means whereby a leakage flow of the medium acting upon the piston cap is made to pass practically exclusively through the intermediate pressure chamber.

As a result, the remaining leakage flow is restricted or confined to one location, where such a flow is in fact required for the purpose of torque transmission.

In a fluid pressure unit wherein the rollers are embodied as hollow, and the hollow spaces are exposed to the pressure of the medium via channels which terminate in the side walls, parallel to the direction of rotation, of the radial bores, the invention provides that for each roller a first channel terminating in the side wall of the radial bore which is parallel to the direction of rotation is intended for the purpose of communication with a pressure source of the medium and a second channel terminating in the other side wall parallel to the direction of rotation communicates with the pressure chamber of the radial bore which is located on the side of the piston cap remote from the roller, in such a manner that the hollow space of the roller is exposed to the flow through it of the medium acting upon the piston cap.

The thermal balance thus attained in the medium flowing through the rollers makes it possible for the gap between the side walls, parallel to the direction of rotation, of the radial bores and the end faces of the rollers to be kept extremely small, so that undesirable leakage becomes negligibly small in amount.

It is also possible to have a fluid pressure unit in which each piston cap is provided with self-adjusting sealing strips in the region of the two side walls, perpendicular to the direction of rotation, of the radial bore. This arrangement is such that the intermediate pressure chamber is located between a particular sealing strip and the variable gap, and each piston cap has support members spaced apart from the sealing strips, the support members each resting against one face of the cylinder block in order to accept tilting moment on the part of the piston. In this case, the invention provides that the body of each piston cap is equipped with channels, each of which terminates in the associated intermediate pressure chamber and in the support face of the corresponding support element, in order to expose the intermediate pressure chamber to the pressure of the medium.

The support face lifting away from the block at one time is then exposed to the pressure of the medium which acts upon the piston cap and carries this pressure via the associated channel to the intermediate pressure chamber, while the oppositely located support face rests on the side wall, so that the associated channel leading to the low-pressure chamber is closed.

The features noted above may naturally also be used in combination so as to attain a minimal undesired leakage flow of the medium which remains of maximum effectiveness.

The invention will be more readily understood from the description below, taken in conjunction with the accompanying drawings.

DESCRIPTION OF THE PREFERRED EMBODIMENTS

Figure 1:
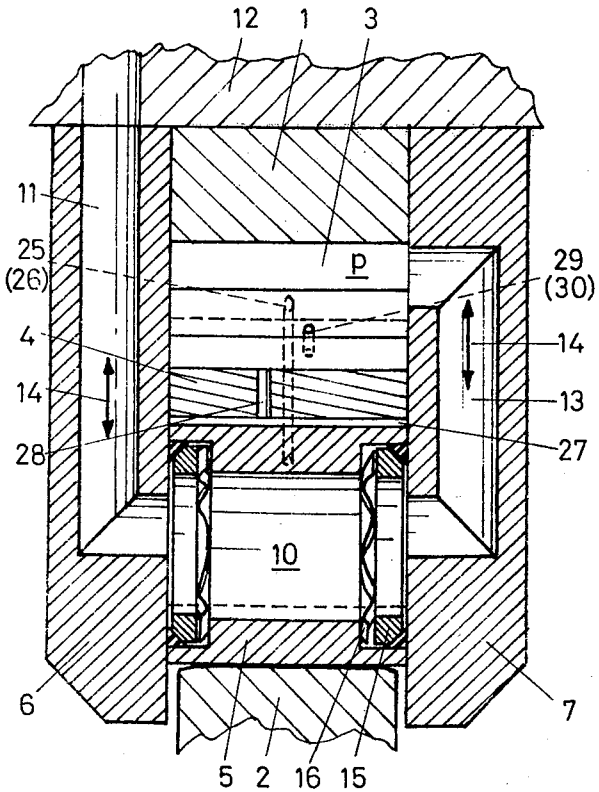
FIG. 1 is a section taken through a first piston arrangement perpendicular to the direction of rotation.

The drawings show only one detail of the radial piston fluid pressure unit, specifically a section of a cylinder block 1 with the associated section of a cam 2 surrounding the cylinder block 1, a single radial bore 3 of square cross section provided in the pertinent section of the cylinder block 1, and a piston disposed in the bore 3. The piston includes a piston cap 4 or 4' exposed to the pressure p of the medium and a roller 5 supported on the cam 2, on which roller 5 the piston cap 4 or 4' is supported in turn. For an overall view of a fluid pressure unit of the present type, reference is made to U.S. Pat. No. 4,144,798, FIG. 1, discussed above.

As shown in the present FIG. 1, the cylinder block 1 has lateral sealing plates 6 and 7, which form the side walls, parallel to the direction of rotation, of the radial bore 3. The two side walls 8 and 9 (FIGS. 2, 3) which are perpendicular to the direction of rotation are embodied by faces of the cylinder block 1.

Figure 2:
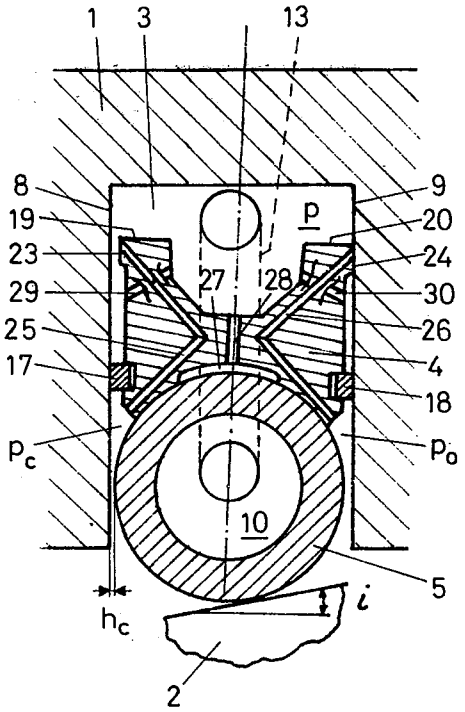
FIG. 2 is a section of the piston arrangement of FIG. 1 parallel to the direction of rotation.
Figure 3:
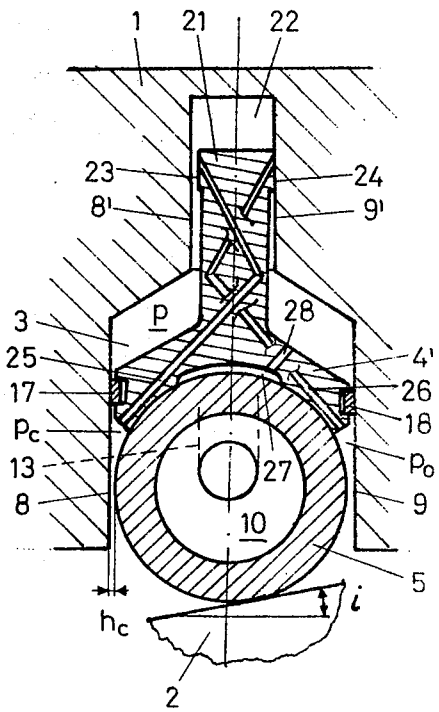
FIG. 3 is a section taken through a second piston arrangement parallel to the direction of rotation.

In the exemplary embodiments of both FIGS. 1, 2 and FIG. 3, the roller 5 is embodied as hollow, with the hollow space 10 exposed to the pressure of the medium. The medium is delivered to the hollow space 10 via a first channel (FIG. 1) located in one side sealing plate 6, and a schematically illustrated distributor 12. The medium flows through the hollow space 10 and is delivered via a second channel 13, which is located in the other side sealing plate 7, to the chamber in the radial bore 3 located above the piston cap 4 or 4'. Depending upon the stroke distance travelled at a particular time, the medium flows in one or the other direction, as is indicated by arrows 14 in FIG. 1. Between the two end faces of the roller 5 and the adjoining side sealing plates 6, 7, sealing rings 15 exposed to the pressure of axially acting springs 16 are arranged to provide practically leakage-free operation.

As may be seen from FIGS. 2, 3, each of the piston caps 4 or 4' is provided with two self-adjusting sealing strips 17 or 18 inserted in the cap body. The sealing strip 17 rests against the side wall 8 which is perpendicular to the direction of rotation, while the sealing strip 18 rests against the opposite side wall 9. In order to accept the tilting moment caused by the pressure distribution being established, the cap body is provided with support elements. In the exemplary embodiment of FIGS. 1 and 2, the upper cap body rims are embodied as support ribs 19 and 20. In the exemplary embodiment of FIG. 3, the cap body is provided with a tang-like extension 21, which is located in a guide bore 22 of the cylinder block 1. Depending upon the direction of inclination of the cam 2 relative to the longitudinal axis of the radial bore 3 or upon the algebraic sign of the angle i shown in the drawing, the support face 23 of one support rib 19 (FIG. 2) or the first support face 23 of the extension 21 (FIG. 3) lifts away from the side wall 8 of the radial bore 3 or from the corresponding wall 8' of the guide bore 22. At the same time, the support face 24 of the other support rib 20 (FIG. 2) or the other support face 24 of the extension 21 (FIG. 3) rests on the opposite wall 9 or 9', respectively.

A channel 25 or 26, respectively, extending in the interior of the body of the respective piston cap 4, 4', terminates at one end in each support face 23, 24 and at the other end in the chamber defined, except for a gap, by the sealing strip 17 or 18, respectively and by the roller 5 and the side wall 8 or 9, respectively.

The piston caps 4, 4' have at their support faces for the rollers 5 a pocket 27, which communicates via a bore 28 with the pressure chamber located above the piston caps 4, 4', so that the pocket 27 is also exposed to the pressure p of the medium.

Finally, in the exemplary embodiment of FIGS. 1 and 2, the intermediate chambers defined by the side walls 8 and 9, respectively, and by sealing strips 17 and 18 and the support faces 23 and 24, respectively, are exposed via further bores 29 and 30 provided in the body of the piston cap 4 or 4' to the pressure p of the medium.

In the exemplary embodiment of FIG. 3, as well, side sealing plates are provided corresponding to those of FIG. 1. The second channel 13, indicated in FIG. 3 only by a broken line, connects the hollow space 10 of the roller 5 again with the chamber located above the piston cap 4'.

During operation, the force of pressure generated by the pressure p of the medium in the rectangular piston bore 3 is defected via the piston cap 4 and 4' and via the pocket 27 onto the roller 5. Because of the inclination i of the cam 2, the roller 5 is forced toward the left in FIGS. 2 and 3, as a result of which a variable gap $h_c$ between the roller 5 and the side wall 8 becomes so small that a pressure $p_c$ is established in the intermediate chamber between the sealing strip 17 and the gap $h_c$ by the delivery of the medium via the channel 25 in the piston cap 4 or 4'. This pressure $p_c$ presses the piston cap 4 or 4' with a certain force against the opposite side wall 9 and also brings about a pressure distribution imbalance, which forces a certain speed on the cylinder block 1. At the same time, the gap between the roller 5 and the side wall 9 opens in such a manner that from the sealing strip 18 of the piston cap 4 or 4' up to the termination of the piston bore 3 a low pressure $p_o$ or no pressure prevails. A leakage flow of the medium from the chamber located above the piston cap 4 or 4' having the pressure p cannot occur via the further channel 26 located in the piston cap 4 or 4' and leading into the last-named low-pressure chamber (that is, that chamber having the pressure $p_o$), because the support face 24 is resting against the side wall 9 or the piston bore 8 (FIG. 2) or against the wall 8' of the guide bore 22 (FIG. 3), as a result of which the mouth of the channel 26 in the support face 24 is closed.

Thus the present embodiment of the piston cap 4 or 4' assures in the intended manner that a leakage flow passes through the place where it is required in order to establish the pressure distribution necessary for torque transmission—that is, through the intermediate pressure chamber having the pressure $p_c$. All further leaks can therefore be suppressed, to the extent that this is technologically possible, because they are not necessary for maintaining the intermediate pressure $p_c$.

A significant source of such remnant leaks is the gaps between the end faces of each roller 5 and the side sealing plates 6 and 7 (FIG. 1) which cover them. On account of thermal expansion, these gaps can generally not be dimensioned as arbitrarily narrow. If the piston flow of the medium, however, as is shown in FIG. 1 and described above, is guided through the hollow space 10 of the roller 5, then this effects a thermal balancing which, without the danger of cavitation, permits extremely small sealing gaps between the end faces of the roller 5 and the side sealing plates 6, 7. The supplementary disposition of the axially yielding sealing rings 15 permits practically leakage-free operation. On this point, however, a slight amount of wear must be taken into account at the side sealing plates 6, 7; still, this wear can be kept within acceptable bounds by the careful selection of materials used therefor.

It is to be understood that the foregoing description of preferred embodiments is given entirely by way of example and that various modifications can be resorted to by those skilled in the art without departing from the spirit and scope of the invention as defined by the appended claims.

What is claimed is:

1. In a pressure fluid pressure unit having a cylinder block which has radial bores of rectangular cross section in which pistons are disposed, each of which has a piston cap periodically exposed to pressure of a medium and a cylindrical roller supported on the piston cap, and having a cam surrounding the cylinder block producing at least one stroke and upon which the rollers are supported, each roller forming a variable gap with a first of two side walls, perpendicular to the direction of rotation, of a respective said radial bore, wherein each said piston cap forms a sealing point with the second of the two side walls, wherein a respective intermediate pressure chamber exposed to the pressure of the medium is located between the variable gap and the piston cap along the first side wall, and wherein the rollers are hollow and their hollow spaces are exposed to the pressure of the medium via channels which terminate in the side walls, parallel to the direction of rotation, of the radial bores, the improvement wherein for each said roller (5) a first channel (11) terminating in the one side wall (6), parallel to the direction of rotation, of a respective said radial bore (3) is intended for communication with a pressure source of the medium and a second channel (13) terminating in the other side wall (7) parallel to the direction of rotation communicates with a pressure chamber (at p) of said respective radial bore (3) located on the side of the piston cap (4) remote from a respective said roller (5) in such a manner that a respective said hollow space (10) of said respective roller (5) is exposed to flow through it of the medium acting upon a corresponding said piston cap (4) and further comprising axially yielding sealing rings (15, 16) disposed between end faces of each said roller (5) and said two side walls (6, 7) of said respective radial bore (3) which are parallel to the direction of rotation.

2. An improved fluid pressure unit as defined by claim 1, wherein each piston cap is provided with self-adjusting sealing strips in the region of the two side walls of the radial bore which are perpendicular to the direction of rotation in such a manner that the respective intermediate pressure chamber is located at a particular time between the one sealing strip and the variable gap, wherein each piston cap has support elements spaced apart from the sealing strips and resting against one face of the cylinder block at a particular time in order to accept piston tilting moment, and wherein the body of each piston cap (4, 4') is provided with channels (25, 26), each of which terminates in said intermediate pressure chamber (at $p_c$) at a particular time and is support face (23, 24) of a corresponding support element (19, 20; 21) in order to expose said respective intermediate pressure chamber to the pressure of the medium.

* * * * *